US006479769B2

(12) United States Patent
Barat et al.

(10) Patent No.: US 6,479,769 B2
(45) Date of Patent: Nov. 12, 2002

(54) FUNCTION-CONTROL DEVICE COMPRISING AT LEAST ONE SELECTOR

(75) Inventors: Didier Barat, Meudon (FR); Andy Nash, Clairefontaine (FR)

(73) Assignee: Valeo Climatisation, La Verriere (FR)

( * ) Notice: Subject to any disclaimer, the term of this patent is extended or adjusted under 35 U.S.C. 154(b) by 0 days.

(21) Appl. No.: 09/837,327

(22) Filed: Apr. 19, 2001

(65) Prior Publication Data

US 2002/0043451 A1 Apr. 18, 2002

(30) Foreign Application Priority Data

Apr. 20, 2000 (FR) ..... 00 05128

(51) Int. Cl.[7] ..... H01H 9/26
(52) U.S. Cl. ..... 200/5 R; 200/4
(58) Field of Search ..... 200/5 R, 18, 336, 200/312–314, 6, 13, 4

(56) References Cited

U.S. PATENT DOCUMENTS 4,131,033 A * 12/1978 Wright et al. ..... 200/316
5,747,759 A * 5/1998 Lochmahr et al. ..... 116/205
5,883,346 A * 3/1999 Stocken ..... 200/18

FOREIGN PATENT DOCUMENTS

| | | |
|---|---|---|
| DE | 3737087 | 5/1989 |
| EP | 0274670 | 7/1988 |
| EP | 0834412 | 4/1998 |

* cited by examiner

*Primary Examiner*—Elvin Enad
*Assistant Examiner*—M. Fishman
(74) *Attorney, Agent, or Firm*—Liniak, Berenato & White

(57) ABSTRACT

The invention relates to a function-control device employing at least one selector which can be shifted between at least two selection positions. The function control device includes a plurality of actuators which can be controlled by a user and at least some of which drive different functions for at least two different positions of a selector symbols, the displaying of which relates to the movement of at least one such selector so as visually to display the function of at least some of the actuators driving different functions.

12 Claims, 3 Drawing Sheets

FUNCTION-CONTROL DEVICE COMPRISING AT LEAST ONE SELECTOR

BACKGROUND OF THE INVENTION

The invention relates to a function-control device comprising at least one function selector and intended especially to equip the console of a motor vehicle.

Vehicles nowadays are equipped with a certain number of comfort and entertainment functions, such as:

car radio, air conditioning, telephone, data communications service (traffic information, cinema/theatre reservations, weather, etc.), navigation, Internet access, electronic mail, DVD, etc.

In general, these functions are presented in the form of a series of electronics boxes (often according to the DIN standard) with their own control interface, which are installed in the central console.

From the point of view of user-friendliness, this solution makes it possible to delimit the functions well, by grouping them together into areas in the central console.

Unfortunately, the multiplication of the new functions and the limited space on the central console impose a limit on this type of solution.

Moreover, the multiplication of the keys makes comprehension difficult.

Another way consists in offering multi-function control interfaces with the following keys:

setting-up keys;

selection key;

enable key;

cancel key;

menu-access key.

Such an approach makes it possible very substantially to reduce the space used on the central console, but it imposes significant concessions on ergonomics, the understanding of the menus and the speed of access to the function which it is desired to set up.

Moreover, in many cases, a control-interface screen has to be placed beside the keys in order to explain their action as a function of the context.

This is hardly compatible with the ergonomics which are expected in a motor vehicle, one constraint being that the control of the functions should distract the driver's attention as little as possible.

The invention proposes at least partially to remedy the abovementioned drawbacks.

SUMMARY OF THE INVENTION

The basic idea of the present invention is to propose function-control means identification of which is achieved by a symbol which can be changed as a function of the context.

The invention thus relates to a function-control device employing at least one selector which can be shifted between at least two selection positions, characterized in that it includes:

a plurality of actuators which can be controlled by a user and at least some of which drive different functions for at least two different positions of a selector;

symbols, the shifting of which relates to the movement of at least one said selector so as to display the function of at least some of the said actuators driving different functions.

At least one selector may be rotary.

The device may feature at least one tilting device, for example a games joystick, controlling several actuators.

At least one said tilting device and at least one said rotary selector are advantageously coaxial. This is very advantageous from the ergonomics point of view.

The device may feature a knurled wheel coaxial with at least one tilting device, in the rest position.

According to a preferred variant, the device features at least one control element which is both rotary and tilting, so as, by rotation, to control the movement of at least one said selector, and the tilting of which controls several actuators.

At least one actuator can be arranged directly in line with an actuating element, for example a key, which can be controlled by at least one of a user's fingers.

At least one symbol can be arranged directly in line with an actuator. In the case in which an actuating element is also arranged directly in line with the actuator, there is coincidence in space between the visual appearance and the manual appearance of the control, which is particularly ergonomic.

At least one selector may feature a facade pierced with slots, the movement of the selector driving that of a piece carrying symbols so as to position them selectively opposite the slots.

At least one selector may feature a non-opaque surface, for example a film, exhibiting the said symbols, which is driven by the movement of the selector and which is back-lit in regions where it is desired to make a symbol appear.

BRIEF DESCRIPTION OF THE DRAWINGS

Other characteristics and advantages of the invention will appear better with the aid of the description which will follow, given by way of non-limiting example, in connection with the attached drawings, in which.

DETAILED DESCRIPTION OF THE PREFERRED EMBODIMENTS

Figure 1:
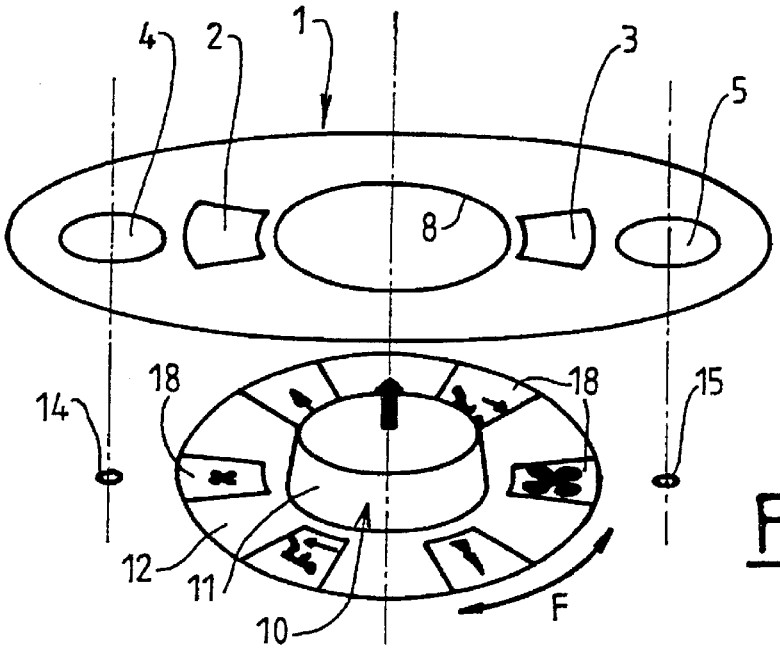
FIGS. 1 and 2 illustrate two embodiments of the present invention.

The embodiment of FIG. 1 shows a device according to the invention, which features an opaque facade 1 featuring apertures or slots 2 and 3, as well as flexible regions 4 and 5 intended, via pressure, to control actuators 14 and 15 such as switches.

The facade 1 covers a selector 10, a cylindrical or frustoconical central region 11 of which accommodates the central aperture 8 of the facade 1. The selector 10 features a crown ring 12 which exhibits a certain number of symbols 18, here pictograms, distributed over its periphery, in such a way as to come to be positioned opposite the slots 2 and 3 for the various positions which the selector 10 is capable of taking up. When the facade 1 is bearing on the selector 10, the user may turn the selector 10, with the aid of the region 11, so as to position it into the various possible positions. The pictogram 18 which appears through the slot 2 corresponds to the function of the switch 14, while the pictogram which appears through the slot 3 corresponds to the function of the switch 15. The rotation of the selector into its various positions induces a change in the function of the switches 14 and 15, in correspondence with the pictograms. To that end, the selector 10, in a known way, features a function, for example computer-based, of programming of the function of the switches 14 and 15. Alternatively, the selector 10 may entrain the switches in movement, and, in this case, one switch corresponds to each pictogram.

Figure 2:
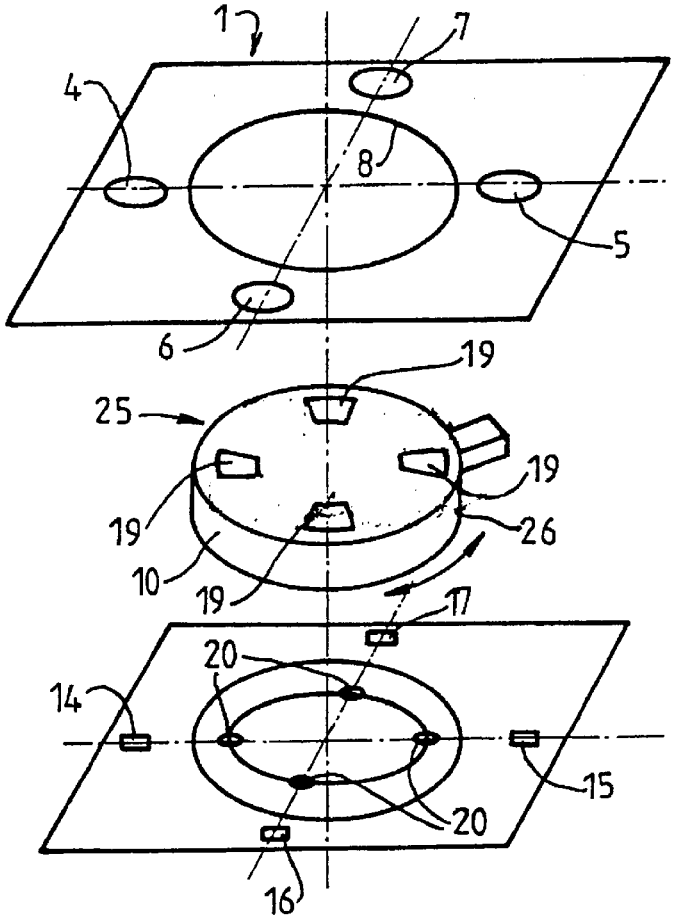

The embodiment of FIG. 2 shows a selector 10 consisting of a large, flat rotary knob 25 which is housed in the aperture 8 and the upper face 26 of which is marked with symbols 19 which are back-lit by light-emitting diodes 20. In the drawing, four symbols 19 have been shown, lit by four of these diodes 20, and four switches 14, 15, 16, 17 which can be actuated by four flexible regions or four keys 4, 5, 6 and 7 of the facade 1. A polycarbonate film is used, for example, printed with icons 18, which are not visible when they are not illuminated. Such films are widely used for manufacturing rear faces of instrument panels, especially for warning lights.

In the context of the invention, it is possible, needless to say, to employ linear selectors in the form of pull-out controls.

In order to take maximum advantages of the possibilities of this type of control, and in order to have more intuitive ergonomics, it is proposed to associate a selector with a main function.

For the central console of a motor vehicle, it is possible, for example, to identify three selectors:

an "audio" selector;

an "air-conditioning " selector;

a "communications" selector.

For each of these selectors, various examples of operating modes will be found below:

Audio function:

CD mode;

radio mode;

option mode;

off mode O or "OFF";

Air-conditioning function:

manual mode;

automatic regulation mode;

off mode O or "OFF";

Communications function:

telephone book mode;

option mode;

"OFF" mode.

Finally, for each of the proposed modes, several settings are proposed, for example 4, for direct access.

In order to limit the space required for such a system, the selector is preferably used both in rotation, in order to choose the mode, and in tilting in two axes (vertical/horizontal) for the setting-up keys. Moreover, in order to make this control more compact, a coaxial knurled wheel can be employed in addition to the selector for additional adjustments (volume, etc.). Alternatively, the control of the selector may undertake the function of this knurled wheel.

Figure 3:
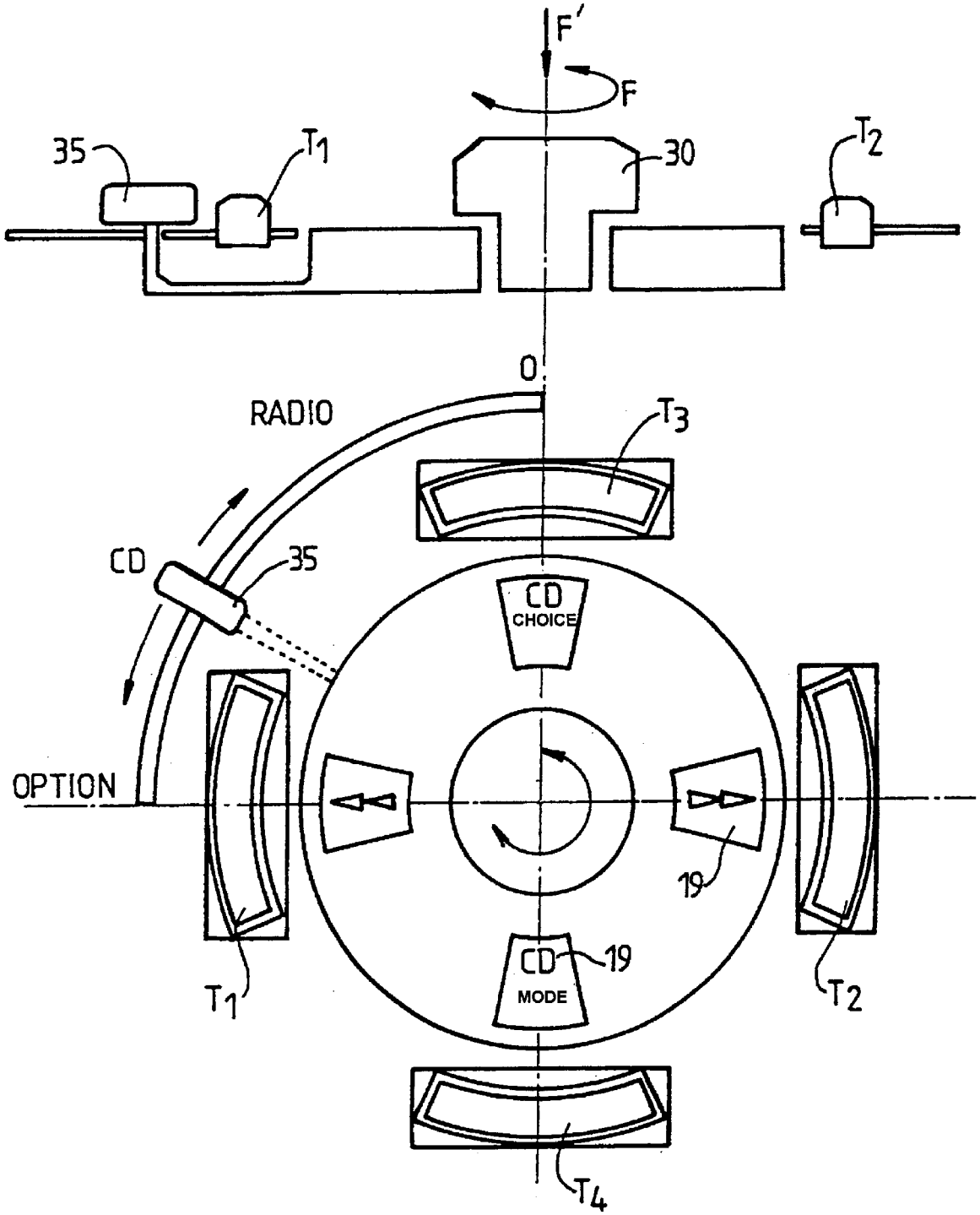
FIG. 3 represents an embodiment of the invention with a rotary selector, the various positions of which are illustrated in FIGS. 4*a* to 4*c;*

FIG. 3 illustrates an embodiment of the invention in which the selector is actuated in rotation by a knob 30 returned by a spring.

Figure 4A:
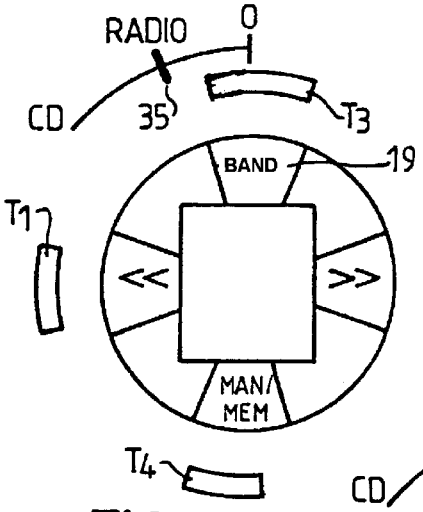

To select a mode (Radio, CD, Option, O) which is identified for the user by an index 35 linked to the selector 10, the user presses on the knob 30 (arrow F'), and then turns it (arrow F). In RADIO position (FIG. 4*a*), the volume adjustment is obtained by rotating the knob 30 (not pushed in).

A change of band (AM/FM/SW) is obtained by pressing on the key $T_3$ opposite the "BAND" symbol, changes of frequency (in steps or between memory-stored frequencies) are achieved via the left keys $T_1$ (to reduce the frequency) and right keys $T_2$ (to increase the frequency). The lower key $T_4$ serves to pass from the manual mode MAN to the memory mode MEM, for the choice of frequencies.

Figure 4B:
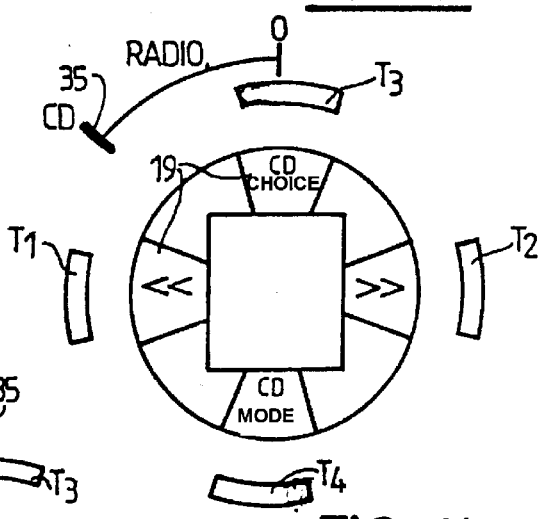

In CD position (FIGS. 3 and 4*b*), adjusting of the volume is achieved via the knob 30 (not pushed in). A change of track is obtained via the keys $T_1$ and $T_2$ opposite the corresponding pictograms. Finally, the choice of replay mode (normal replay, repetition, random, or sampling of the starts of tracks, "scan") is obtained via the lower key $T_4$.

Figure 4C:
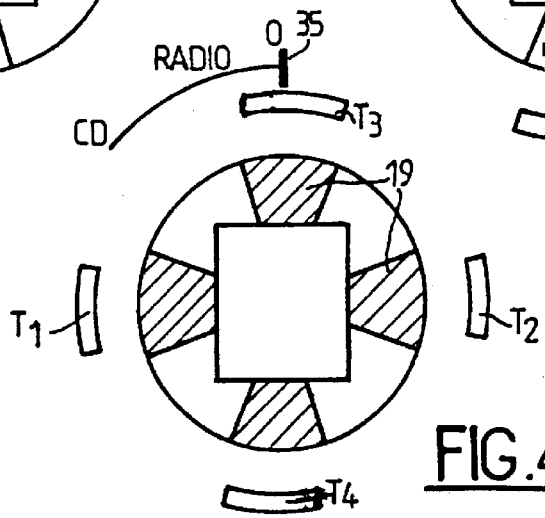

In off or 0 position (FIG. 4*c*), no pictogram appears and the keys $T_4$ to $T_4$ are inactive.

In another position, "OPTION", the keys $T_3$ and $T_4$ may serve to select an option (balance, bass, treble, "RDS" function, etc.). The keys $T_1$ and $T_2$ serve to enable or disable the option.

Figure 5:
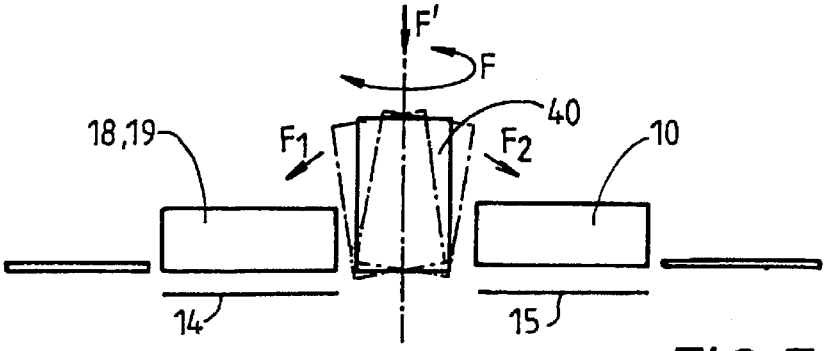
FIGS. 5 and 6 represent two embodiments of the invention implementing a tilting and a rotation.

FIG. 5 represents a device which is controlled by a "games joystick" 40 which combines movements in rotation and in tilting.

By pressing on the joystick 40 in the direction of the arrow F', the selector 10 is declutched, and the rotation of the joystick 40 makes it possible to place the selector 10 into a chosen mode. Inclining the joystick in the direction of the arrows $F_1$, $F_2$, etc. then makes it possible to act on the actuators, such as switches 14 . . . 17, of the selector 10.

Figure 6:
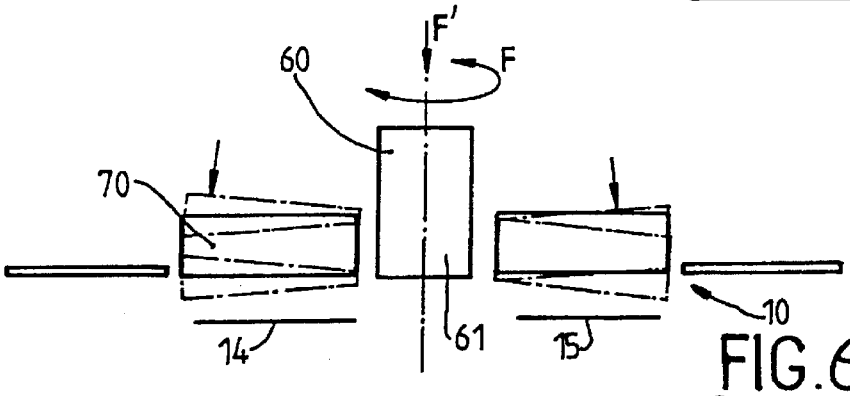

In the embodiment of FIG. 6, the joystick or knurled wheel 60 features solely the rotational function allowing selection of selector 10 mode. The actuators (14 . . . 17) are actuated by tilting of an annular piece 70 which surrounds the base 61 of the knurled wheel 60.

In the embodiment of FIGS. 5 and 6, the actuators are advantageously arranged directly in line with the symbols (18, 19). In the case of FIG. 5, it is the position of the joystick 40, turned (arrows $F_1$ and $F_2$) towards the chosen symbol or the pictogram which controls the actuator (14 . . . 17) corresponding to the function sought. In the case of FIG. 6, it is possible to act on the actuator by pressing on the pictogram which covers the upper face of the tilting piece 70. In either of the cases, the ergonomics are particularly good.

The advantages of the invention can be enumerated in the following way:

- the ergonomics principle which consists in having one all-in-one knob for a function is respected;
- in each context, the basic parameters of a function are directly accessible. Example: when listening to a CD, a change of track or change of disc can be carried out by pressing directly on a key;
- the correct commands are offered in a given context. Example: when listening to a CD, the system does not offer keys making it possible to change the frequency band of the radio. The user is not bothered by unnecessary keys;
- the use of the system is made intuitive by virtue of an identification of the parameter directly on the key;
- the reduction in the number of knobs allows their size to be increased. Such a control panel can be used with gloves;
- by virtue of the technology of back-lit polycarbonate, color effects can be obtained on the knobs. It is possible, moreover, to identify a mode of adjustment with a color;
- the invention is compatible with a screen remote from the control interface;
- when the functions are in inactive position, "OFF", it is possible to have a completely black, all-in-one knob, resulting in the device being discreet.

the simplification of use, the reduction in the number of keys, the legibility of the panel, the use of color, enhance the safety of use of such a control interface.

the multifunction approach for each all-in-one knob makes it possible to do away with unused keys on bottom-of-the-range versions. Moreover, the use of sheets of back-lit polycarbonate makes it possible to keep options completely secret as long as they are not lit;

customizing of the control interface with symbols in the correct language is made less expensive by virtue of the back-lit polycarbonate. This is because polycarbonate is obtained by a printing method and it does not give rise to expensive special-purpose tooling, and makes it easily possible to have different versions available in different languages;

the simplicity of the controls means that no contextual help key needs to be added;

the possible use of back-lit polycarbonate makes it possible to deal simply with the problem of display by night;

the option mode possibly present on each all-in-one knob makes it possible easily to integrate new functionalities (handled by software);

all the adjusting keys can be indicated with icons of the same size;

the invention applies for 1, 2, 3, etc. all-in-one knobs.

What is claimed is:

1. Function-control device employing at least one selector which can be shifted between at least two selection positions, including:

a plurality of actuators for an electronic device which can be controlled by a user wherein at least some of said actuators drive different functions for at least two different positions of said at least one selector; and at least one symbol representing said different function, a repositioning of said symbol is controlled by a rotary movement of said at least one selector so as to display the function of at least some of said actuators driving said different functions.

2. The device according to claim 1, wherein said movement of said at least one said selector is rotary.

3. The device according to claim 1, wherein said at least one selector comprises at least one tilting device controlling several actuators.

4. The device according to claim 3, wherein said at least one tilting device and said at least one selector are coaxial.

5. The device according to claims 3, wherein the tilting device is a joystick.

6. The device according to claim 1, wherein said at least one selector comprises at least one knurled wheel coaxial with at least one tilting device.

7. The device according to claim 2, further comprising at least one rotary and tilting control element, the rotation of said control element moves said at least one selector and the tilting of said control element controls at least one of said actuators.

8. The device according to claim 1, wherein said at least one actuator is arranged directly in line with an actuating element which can be controlled by at least one of a user's fingers.

9. The device according to claim 8, wherein said actuating element is an actuating key.

10. The device according to claim 1, wherein said at least one symbol is arranged directly in line with one of said actuators.

11. The device according to claim 1, wherein said at least one selector comprises a facade pierced with slots, the movement of the selector driving said at least one symbol so as to position said at least one symbol selectively opposite at least one of the slots.

12. The device according to claim 1, wherein said at least one selector features a non-opaque surface exhibiting said at least one symbol, said surface being driven by the movement of the selector and being back-lit in regions where appearance of said symbol is desired.

* * * * *